US005983591A

United States Patent [19]

Stigell

[11] Patent Number: 5,983,591

[45] Date of Patent: Nov. 16, 1999

[54] LIGHTENING POLE

[75] Inventor: Harri Stigell, Kuopio, Finland

[73] Assignee: Luxi Wood OY, Kuopio, Finland

[21] Appl. No.: 08/917,846

[22] Filed: Aug. 27, 1997

Related U.S. Application Data

[63] Continuation of application No. 08/503,689, Jul. 18, 1995, abandoned, which is a continuation of application No. PCT/FI95/00184, Apr. 5, 1995.

[30] Foreign Application Priority Data

Apr. 5, 1994 [FI] Finland ..... 940190 U

[51] Int. Cl.[6] ..... E04H 12/04

[52] U.S. Cl. ..... 52/736.1; 52/726.4; 174/45 R

[58] Field of Search ..... 52/220.1, 722.1, 52/726.3, 726.4, 732.3, 736.1, 736.2; 174/45 R

[56] References Cited

U.S. PATENT DOCUMENTS

| | | | |
|---|---|---|---|
| 1,085,144 | 1/1914 | Massey | 52/736.2 |
| 1,085,145 | 1/1914 | Massey | 52/736.2 |
| 3,562,403 | 2/1971 | Monahan | 52/40 |
| 3,598,393 | 8/1971 | Mater | 408/37 |
| 3,755,977 | 9/1973 | Lewis | 52/726.4 |
| 3,853,418 | 12/1974 | Druin et al. | 52/726.4 |
| 5,398,478 | 3/1995 | Gordin et al. | 52/726.4 |
| 5,438,812 | 8/1995 | Erickson | 52/726.4 |

FOREIGN PATENT DOCUMENTS

| | | | |
|---|---|---|---|
| 37731 | 7/1927 | Denmark . | |
| 44850 | 9/1971 | Finland . | |
| 1175466 | 3/1959 | France | 52/726.4 |
| 1434607 | 3/1970 | Germany . | |
| 443014 | 2/1986 | Sweden . | |

*Primary Examiner*—Michael Safavi
*Attorney, Agent, or Firm*—Pillsbury Madison & Sutro LLP

[57] ABSTRACT

A solid wooden pole (1) for use as a lighting pole or as a decoration pole. To improve the versatility of the pole, the center part (2) of the pole is provided with a bore (3) extending longitudinally through the pole. An electrical cable may be provided in the bore to provide a durable structure which is significantly less expensive to manufacture than a metal or plastic pole.

4 Claims, 5 Drawing Sheets

LIGHTENING POLE

This is a continuation of U.S. application Ser. No. 08/503,689, filed on Jul. 18, 1995, now abandoned, which is a continuation of PCT international application PCT/FI95/00184.

the present invention relates to a pole, particularly a wood pole.

Conventionally, lighting poles, decoration poles and other poles are manufactured as wood, plastic or metal poles. An advantage of metal or plastic poles is the possibility of making such poles with a hollow core, whereby an electrical cable, electrical conductor or a device may be inserted in a protected space inside the pole. However, metal poles have been plagued by a high price and plastic poles have been lacking sufficient durability.

In solid-wood poles the electrical cable or similar element or other device must be placed onto the pole perimeter or in a groove made thereto in a coverable manner. An electrical cable or similar element fixed on the pole perimeter is easily damaged and the installation thereof in a purpose-made groove and subsequent covering of the groove are awkward operations.

It is an object of the present invention to provide a wood pole capable of overcoming the drawbacks of conventional poles. It is a particular object of the invention to provide a wood pole in which an electrical cable or similar element can be mounted in a safe place in a simple and cost-efficient manner. It is still another object of the invention to provide a wood pole having a durable structure.

The goal of the invention is achieved by means of a pole characterized by what is stated in the appended claims.

According to the invention, the center of the pole is provided with a borehole extending longitudinally through the pole. Such a borehole is advantageously suited for placing an electrical cable, an electrical conductor or other device. Then, the electrical cable or similar element is protected inside the pole. Making a borehole in a wood pole is easy, and an electrical cable or similar element can be easily threaded into the borehole or into a conduit inserted in the borehole. By placing the borehole along the center axis of a lighting pole, an extra advantage is gained therein that volumetric movement of the wood caused by humidity variations cannot affect the center part of the pole and the electrical cable, electrical conductor or other device located therein. By virtue of the center borehole, the wood will dry evenly from its center and outer parts, and checks in the perimeter of the pole are avoided. Moreover, the center borehole can be arranged to conduct an airflow, whereby the borehole becomes ventilated.

In the following the invention is described in more detail with reference to the attached drawings, in which.

Figure 1:
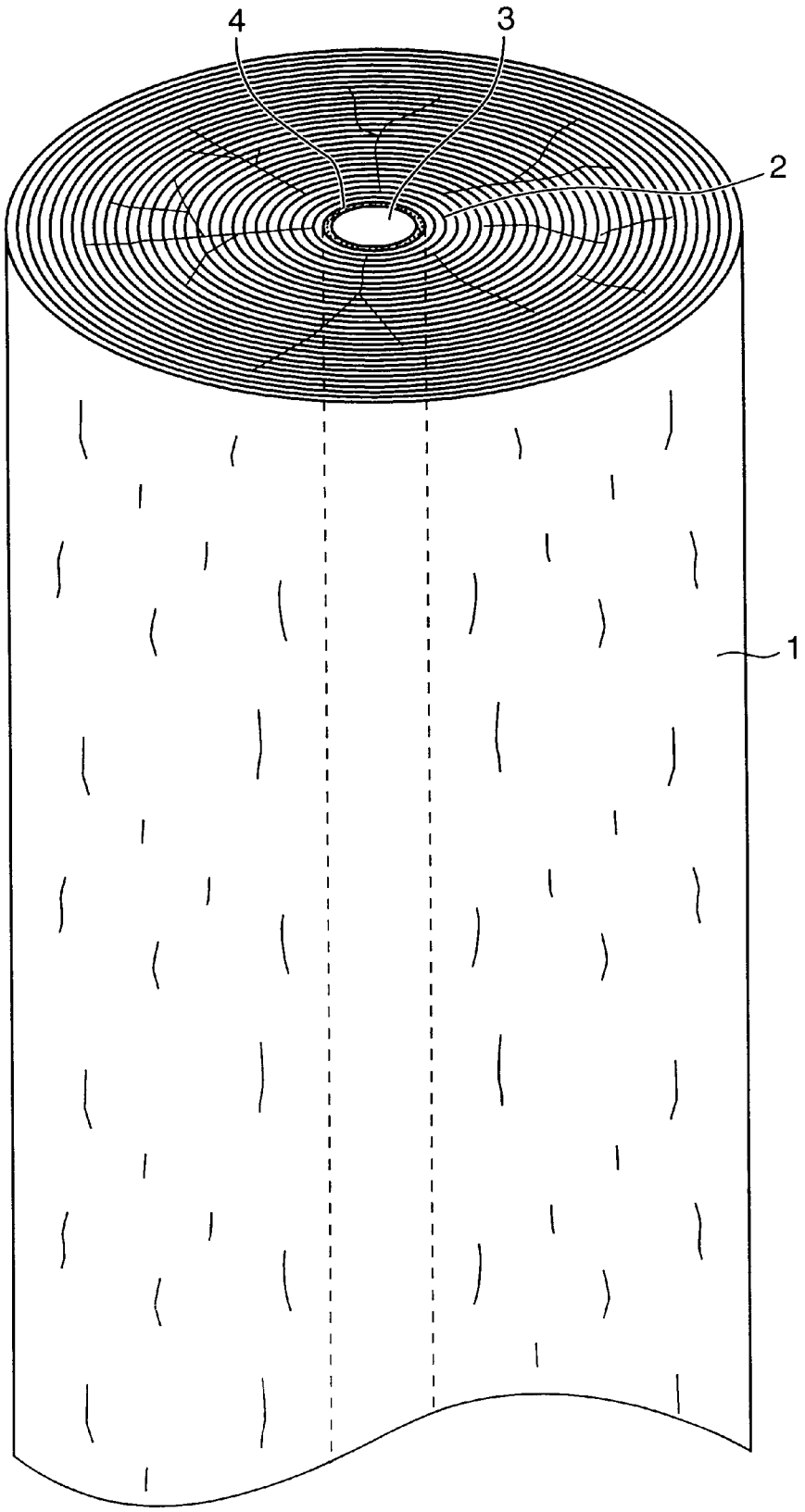
FIG. 1 is a partially sectioned side view of an embodiment of the pole according to the invention.
Figure 2:
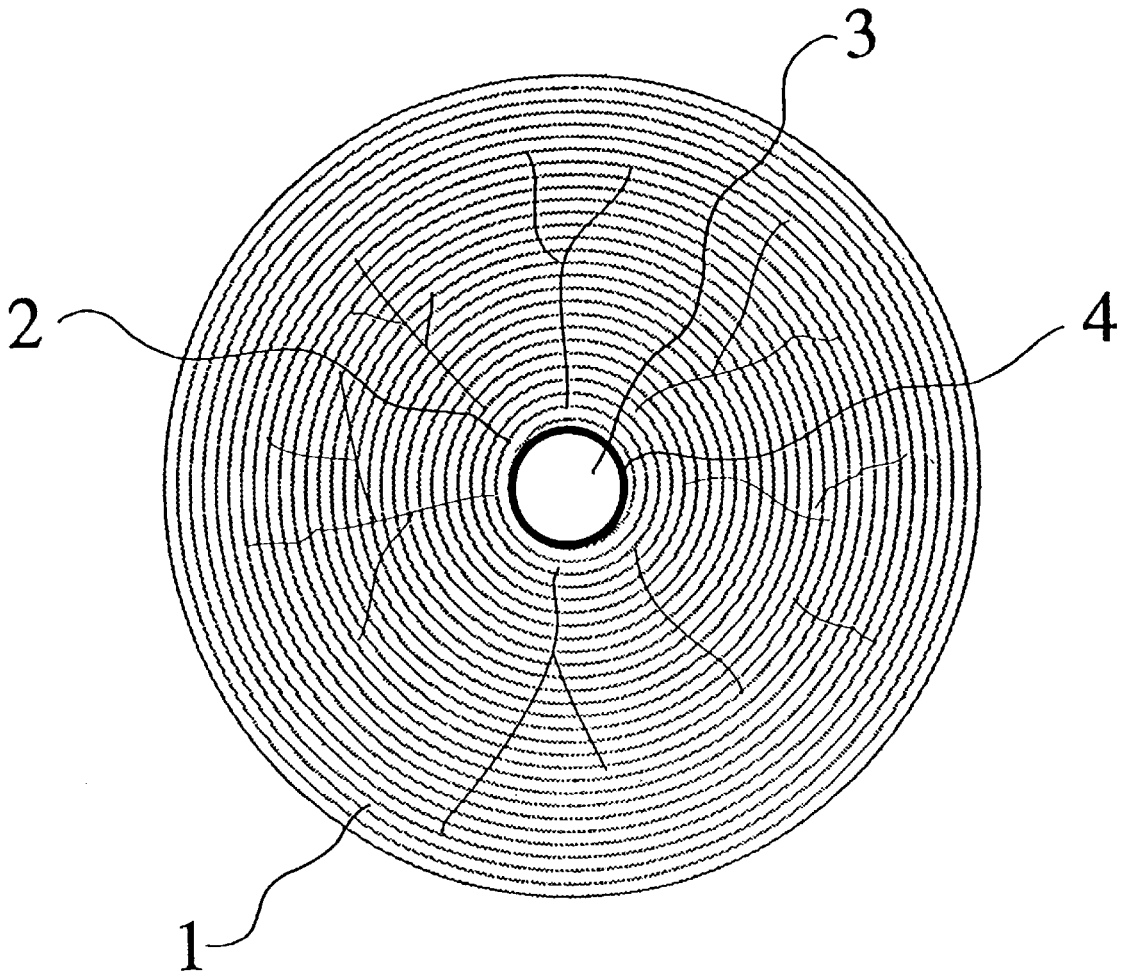
FIG. 2 is a top view of the lighting pole illustrated in FIG. 1.
Figure 3:
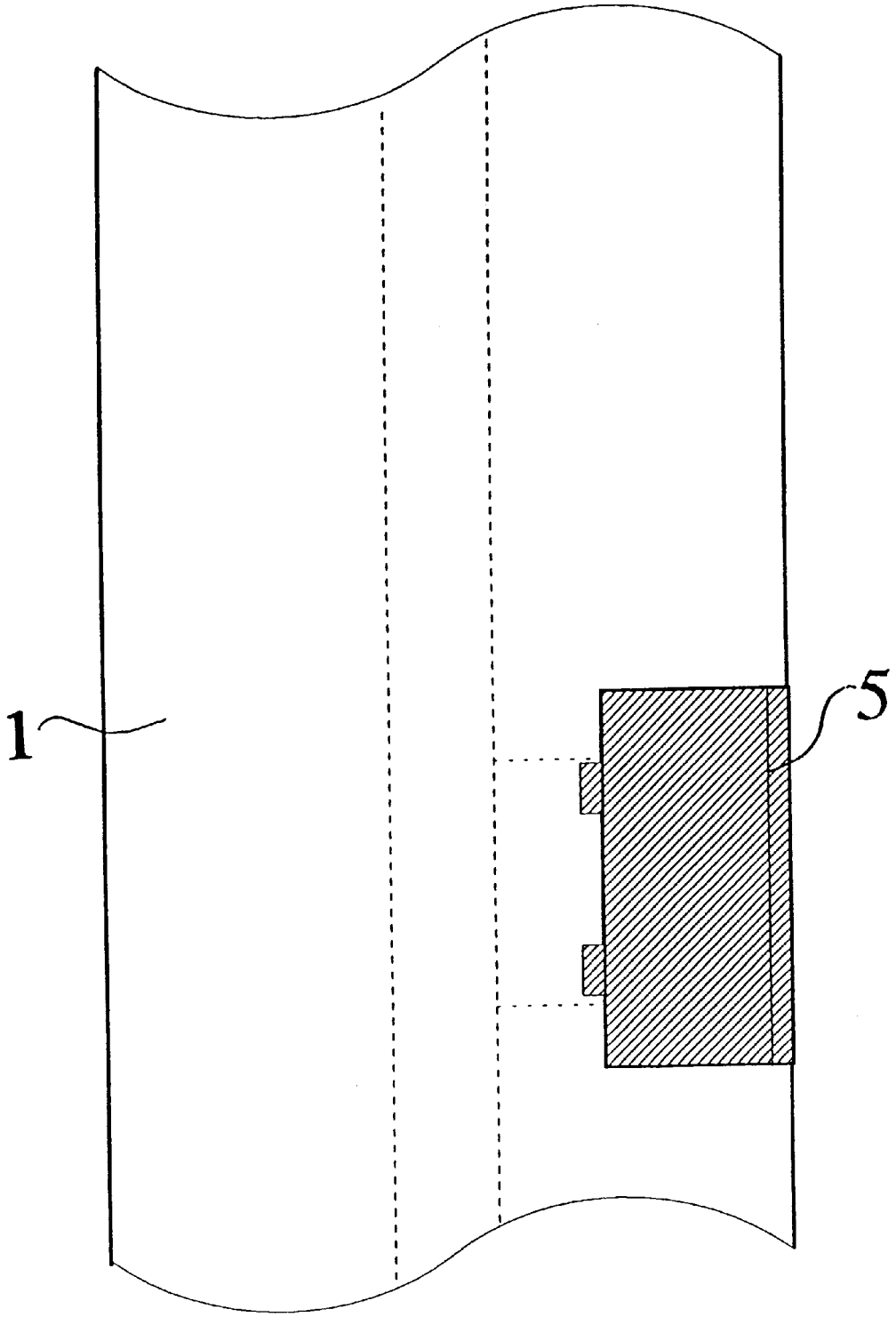
FIGS. 3, 4A and 4B illustrate the butt part of the pole and connection boxes mounted thereto.
Figure 4B:
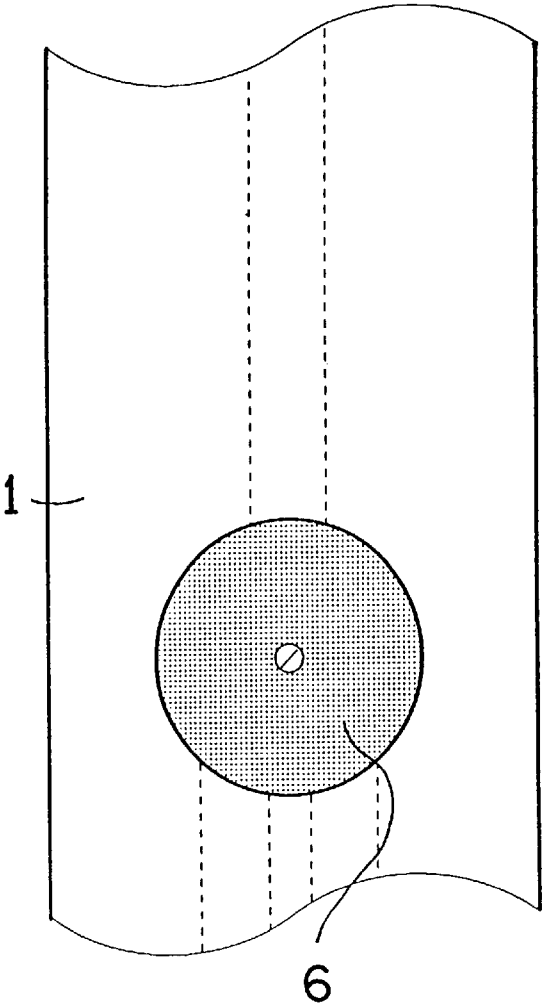
Figure 4A:
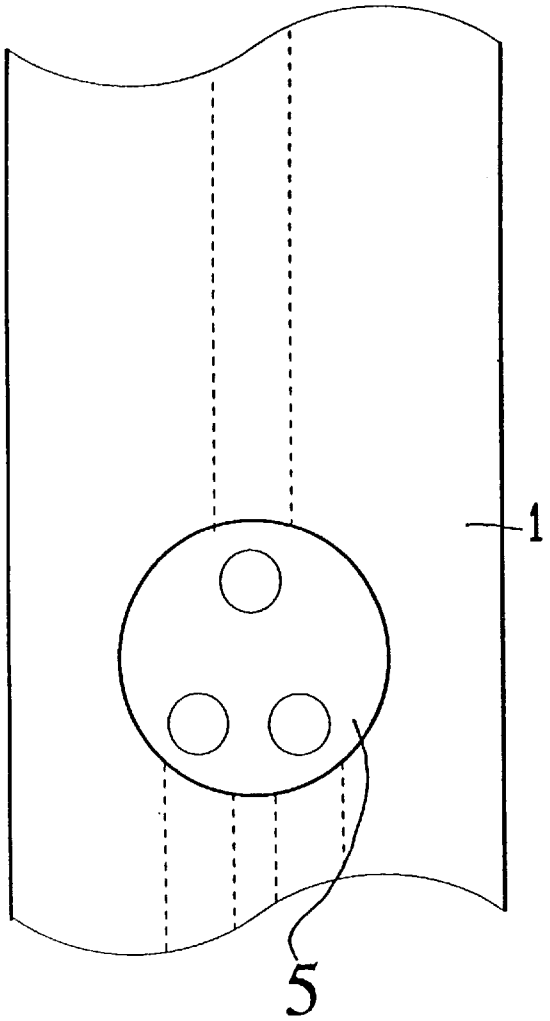
Figure 5:
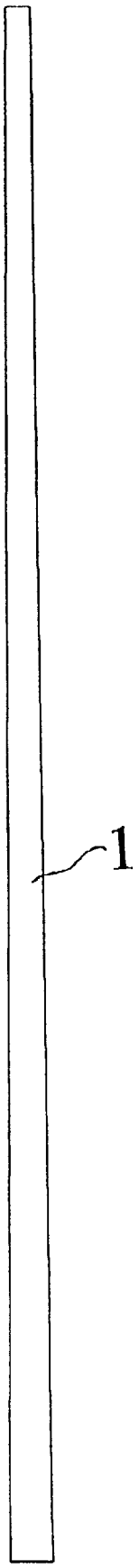
FIG. 5 is a side view of a pole according to the invention.
Figure 6:
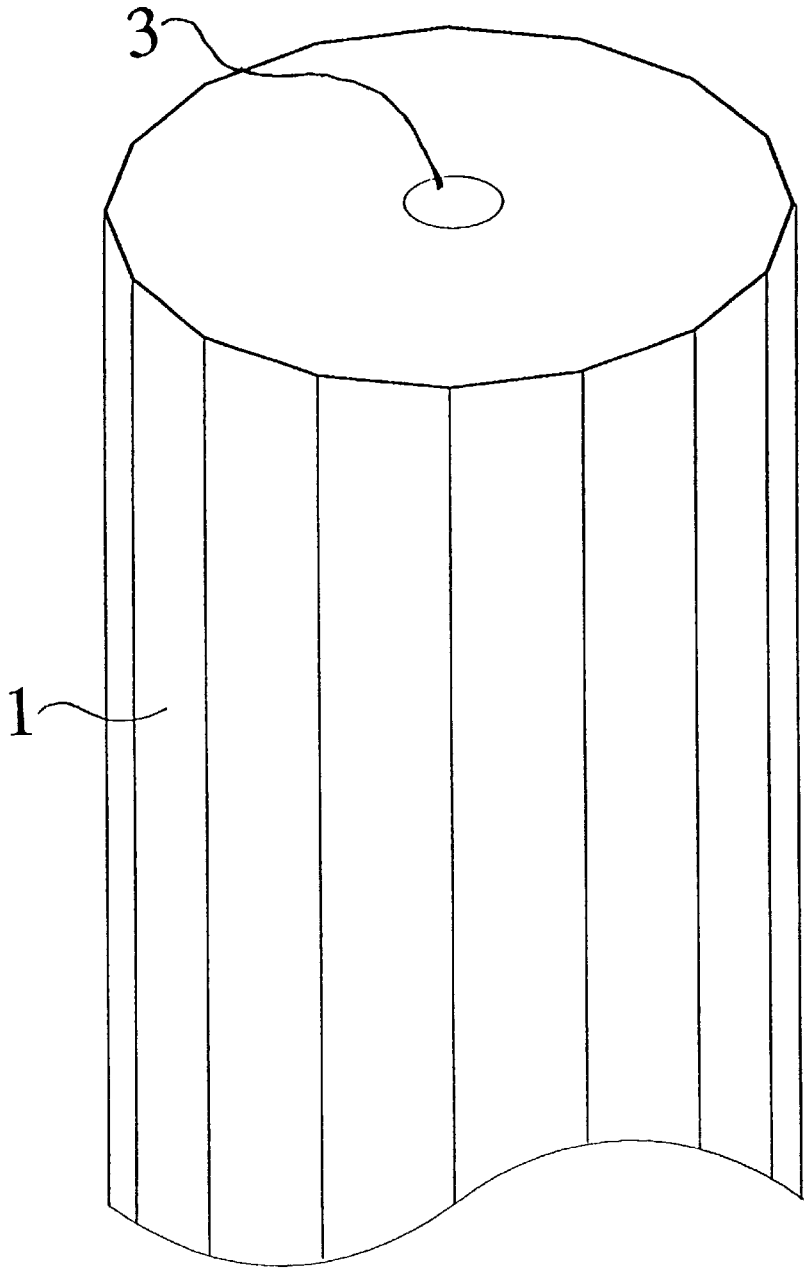
FIG. 6 illustrates the top part of the pole shown in FIG. 5 in an enlarged scale.

Referring to the figures, a lighting pole 1 illustrated therein is made from wood and is treated with a suitable preservative to assure a long service of the lighting pole. For this purpose, a conventional preservative is used capable of preventing the wood from decaying and stopping the movement of the wood due to changes in the ambient relative humidity. To the center 2 of the pole is drilled a borehole 3 extending from end to end through the pole along its center axis. Into the borehole is inserted a conduit 4 and an electrical cable may be placed into the conduit by threading the cable through the conduit. When connecting the lighting poles in series, a connection box 5 of the conductors is mounted in a recess drilled to the butt part of the pole at a suitable mounting height. The connection box 5 including a cover plate 6 as shown in FIG. 4B. FIGS. 3 and 4 illustrate the method of mounting the connection boxes in the pole. Referring to FIGS. 5 and 6, in the embodiment shown therein the pole is shaved into a sixteen-facet form and retaining the natural taper of the wood toward its top. E.g., when the pole length is four meters, the butt diameter may be approx. 120 mm, while the top diameter is approx. 80 mm. Also other alternative shapes are possible, whereby the poles in some applications may have longitudinally a constant cross section and/or circular cross section.

To a person versed in the art, it is obvious that the invention is not limited to the exemplifying advantageous embodiment described above, but rather, can be varied within the inventive scope and spirit of the appended claims.

I claim:

1. A wood pole for carrying electric cables or conductors, the pole being provided with a central longitudinal hole extending through the pole, wherein the pole consists of a single, solid wood piece, and wherein the central hole is disposed in the single solid wood piece so as to direct and carry the electrical cables or conductors therethrough, wherein the pole is provided with a connection box for connecting electric cables or conductors, wherein the connection box is in a recess adjacent a bottom part of the pole.

2. A wood pole according to claim 1, wherein the connecting box includes connections for connecting a plurality of poles in series.

3. A wood pole according to claim 1, wherein the connecting box is arranged at a predetermined mounting height.

4. A wood pole according to claim 1, wherein the connecting box is provided with a cover plate for covering a recess thereof.

* * * * *